US012583565B2

(12) United States Patent
Shane et al.

(10) Patent No.: US 12,583,565 B2
(45) Date of Patent: Mar. 24, 2026

(54) THERMAL MANAGEMENT FOR DIVERS

(71) Applicant: Boston Engineering Corporation, Waltham, MA (US)

(72) Inventors: David J. Shane, Woburn, MA (US); Robert Lee Cardenas, Framingham, MA (US); Steven James Simas, Amherst, NH (US); Michael Rufo, Hanover, MA (US)

(73) Assignee: Boston Engineering Corporation, Waltham, MA (US)

( * ) Notice: Subject to any disclaimer, the term of this patent is extended or adjusted under 35 U.S.C. 154(b) by 3 days.

(21) Appl. No.: 18/665,029

(22) Filed: May 15, 2024

(65) Prior Publication Data

US 2024/0383589 A1 Nov. 21, 2024

Related U.S. Application Data

(60) Provisional application No. 63/466,412, filed on May 15, 2023.

(51) Int. Cl.
*B63C 11/04* (2006.01)
*B63C 11/28* (2006.01)

(52) U.S. Cl.
CPC ..... *B63C 11/04* (2013.01); *B63C 11/28* (2013.01); *B63C 2011/043* (2013.01)

(58) Field of Classification Search
CPC ..... A41D 13/005; A41D 13/0051; A41D 13/0053; B63C 11/04; B63C 2011/043; B63C 11/28
See application file for complete search history.

(56) References Cited

U.S. PATENT DOCUMENTS 3,367,319 A 2/1968 Carter, Jr.
3,391,405 A * 7/1968 Wiswell, Jr. ..... B63C 11/28 2/2.17
3,391,686 A * 7/1968 Wiswell, Jr. ..... B63C 11/28 607/104
3,419,702 A * 12/1968 Piel ..... B63C 11/04 338/222
3,449,761 A * 6/1969 Long ..... B63C 11/28 2/2.15
3,450,127 A * 6/1969 Van Ness Harwood, Jr. ..... B63C 11/28 165/46
3,497,672 A * 2/1970 Sundstrom ..... F24H 1/102 392/471
3,523,301 A * 8/1970 Davis ..... A62B 17/00 2/2.14

(Continued)

OTHER PUBLICATIONS

Bardy, Eric, et al., "Regional and total body active heating and coooling of a resting diver in water of varied temperatures", IOP Publishing, Journal of Physics D: Applied Physics, 2008, 13 pages.

*Primary Examiner* — F Griffin Hall
(74) *Attorney, Agent, or Firm* — BainwoodHuang

(57) ABSTRACT

A technique for delivering heating or cooling to a diver includes a suit that includes a water-impermeable outer layer, an insulating layer having a channel extending along a diver-facing surface thereof, and a tube disposed within the channel of the insulating layer. The tube is constructed and arranged for carrying heat-transfer fluid to a proximity of the diver's skin.

23 Claims, 5 Drawing Sheets

(56) References Cited

U.S. PATENT DOCUMENTS 3,556,205 A * 1/1971 Van Ness Harwood, Jr. ..... B63C 11/28 165/46
3,568,209 A * 3/1971 O'Neill ..... B63C 11/04 219/211
3,572,314 A * 3/1971 Teague ..... B63C 11/28 126/210
3,599,625 A * 8/1971 Curtis ..... C09K 5/16 126/14
3,644,706 A * 2/1972 Larenzo ..... B63C 11/28 392/447
3,670,716 A * 6/1972 Esposito ..... B63C 11/04 126/204
3,675,244 A * 7/1972 Mayo ..... B63C 11/04 2/82
3,688,762 A * 9/1972 Chi ..... B63C 11/28 126/204
3,730,178 A * 5/1973 Moreland ..... B63C 11/04 128/201.27
3,744,053 A * 7/1973 Parker ..... B63C 11/28 2/82
3,815,573 A * 6/1974 Marcus ..... B63C 11/28 126/204
3,884,216 A * 5/1975 McCartney ..... A61F 7/03 607/104
4,013,122 A * 3/1977 Long ..... F28D 7/106 126/210
4,067,064 A * 1/1978 Cerniway ..... B63C 11/28 112/419
4,274,759 A * 6/1981 Long ..... B63C 11/28 2/2.15
5,100,261 A * 3/1992 Plemon ..... B63C 11/04 126/204
5,160,828 A * 11/1992 Olsen ..... A61F 7/007 607/101
5,222,548 A * 6/1993 Biggers ..... B63C 11/28 165/905
5,960,469 A * 10/1999 Nuckols ..... A41D 13/002 2/456
7,306,403 B1 * 12/2007 Sanders ..... B63C 11/28 2/2.15
9,963,210 B1 * 5/2018 Ebot ..... A41D 13/0051
10,308,333 B2 * 6/2019 Gill ..... A61F 7/0085
10,702,746 B2 7/2020 Park
11,932,362 B2 * 3/2024 Yu ..... B63C 11/04

* cited by examiner

THERMAL MANAGEMENT FOR DIVERS

CROSS-REFERENCE TO RELATED APPLICATIONS

This application claims the benefit of U.S. Provisional Patent Application No. 63/466,412, filed May 15, 2024, the contents and teachings of which are incorporated by reference herein in their entirety.

STATEMENT REGARDING FEDERALLY SPONSORED RESEARCH OR DEVELOPMENT

This invention was made with government support under contract N00253-17-C-0002 awarded by the U.S. Navy. The government has certain rights in the invention.

BACKGROUND

Underwater persons typically wear diving suits to help regulate their body temperatures and protect them from contact hazards. The suits may be provided as dry suits or wet suits. A dry suit is designed to keep water out and to maintain a dry environment within the suit. By contrast, a wet suit is designed to contain a volume of water. The water is in direct contact with the diver's skin and provides some degree of thermal insulation.

In very cold waters, additional equipment may be used to maintain a diver's body temperature within safe limits. To this end, dry suits may be packed with layers of insulation. They may also include electrically powered heaters. Wet suits may include similar heaters. A wet suit may alternatively connect to a source of warm water, e.g., through a system of tubes. Warm water flows from the source into the wet suit, where it mixes with water already inside the suit and warms the diver's skin. Return water flows back to the source in a closed-loop arrangement.

SUMMARY

Unfortunately, existing solutions for maintaining safe and comfortable temperatures for divers have deficiencies. Electric heaters require a steady supply of electricity, which is not always available or easily provided to individual divers. They may also present shock hazards. Dry suits stuffed with insulation may be bulky and restrictive when worn underwater for long periods. Wet suits may also be bulky and may have insufficient insulation quality, requiring a high flow rate of warm water to keep temperatures within safe limits. What is needed, therefore, is less bulky and more efficient thermal management that keeps divers safer and more comfortable.

The above need is addressed at least in part by an improved technique for thermal management of divers. The technique includes a dry suit having an internal, insulating layer with cutout channels in which tubes are disposed for carrying heat-transfer fluid to the proximity of a diver's skin. The tubes are recessed within the channels, such that the tubes when inflated with heat-transfer fluid achieve close contact with the diver's skin without concentrating pressure on the diver's skin.

Advantageously, the improved suit efficiently warms or cools the diver without requiring the large volume of insulation typically provided in dry suits designed for extreme-temperature applications. It also enables more extreme temperature operation than wet suits and with less heat loss. In addition, the improved suit is more comfortable for divers to wear. Lower bulk results in easier mobility underwater, and the recessed tubing keeps the divers at comfortable temperatures while avoiding high pressure points on the divers' skin.

In some arrangements, efficiency is further enhanced by providing improved pathways and connectors for conveying water between a heat-transfer fluid supply and one or more diver suits. Such pathways and connectors reduce heat transfer to the environment, promoting more reliable and consistent heating or cooling to divers, and requiring less energy.

Certain embodiments are directed to an apparatus for delivering heating or cooling to a diver. The apparatus includes a suit, and the suit includes a water-impermeable outer layer, an insulating layer having a channel extending along a diver-facing facing surface thereof, and a tube disposed within the channel of the insulating layer, the tube constructed and arranged for carrying heat-transfer fluid to a proximity of the diver's skin.

Other embodiments are directed to a suit for delivering heating or cooling to a diver. The suit includes a water-impermeable outer layer, an insulating layer having a channel extending along a diver-facing surface thereof, and a tube disposed within the channel of the insulating layer, the tube constructed and arranged for carrying heat-transfer fluid to a proximity of the diver's skin.

The foregoing summary is presented for illustrative purposes to assist the reader in readily grasping example features presented herein; however, this summary is not intended to set forth required elements or to limit embodiments hereof in any way. One should appreciate that the above-described features can be combined in any manner that makes technological sense, and that all such combinations are intended to be disclosed herein, regardless of whether such combinations are identified explicitly or not.

BRIEF DESCRIPTION OF THE SEVERAL VIEWS OF THE DRAWINGS

The foregoing and other features and advantages will be apparent from the following description of particular embodiments, as illustrated in the accompanying drawings, in which like reference characters refer to the same or similar parts throughout the different views. The drawings are not necessarily to scale, emphasis instead being placed upon illustrating the principles of various embodiments.

DETAILED DESCRIPTION

Embodiments of the improved technique will now be described. One should appreciate that such embodiments are provided by way of example to illustrate certain features and principles but are not intended to be limiting.

An improved technique for thermal management of divers includes a dry suit having an internal, insulating layer with cutout channels in which tubes are disposed for carrying heated water to the proximity of a diver's skin. The tubes are recessed within the channels, such that the tubes when inflated with water achieve close contact with the diver's skin without concentrating pressure on the diver's skin.

Figure 1:
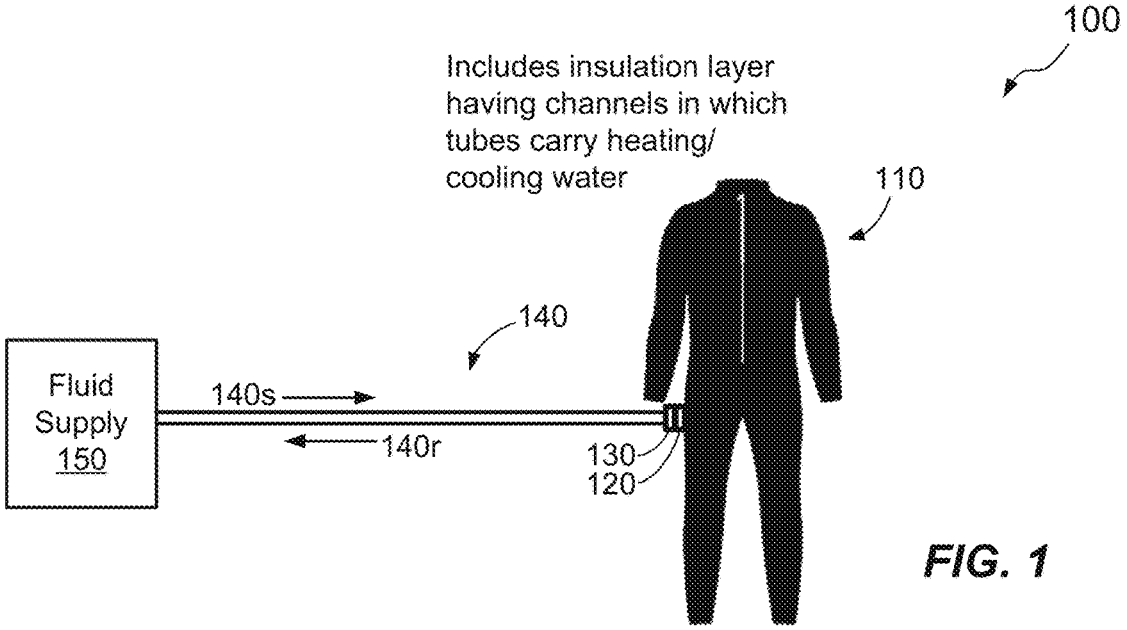
FIG. 1 is a block diagram of an example diving suit and environment in which embodiments of the improved technique can be practiced.

FIG. 1 shows an example environment 100 in which embodiments of the improved technique can be practiced. Here, a diving suit 110 is connected to a fluid supply 150 via water lines 140. In an example, the diving suit 110 is a dry suit designed to maintain a dry environment within the suit. The dry suit 110 is manufactured or modified to include an internal insulating layer having channels in which tubes are disposed for carrying heat-transfer fluid for heating and/or cooling a diver, i.e., a person wearing the suit 110.

In an example, the suit 110 includes a diver-side connector 120 having an inlet that receives temperature-controlled water from the fluid supply 150 and conveys the temperature-controlled water to internal portions of the suit 110. The diver-side connector 120 further has an outlet that returns spent water back to the fluid supply 150. The diver-side connector 120 is configured to mate with a supply-side connector 130, which is connected to the fluid supply 150 via the water lines 140, i.e., a source line 140*s* and a return line 140*r*. In an example, the diver-side connector 120 and the supply-side connector 130 have a quick-disconnect feature that allows the two connectors to be separated merely by pulling them apart.

The fluid supply 150 is configured to provide heated or cooled fluid to the suit 110 in a closed-loop path. To this end, the fluid supply 150 may include one or more pumps, heaters, chillers, or the like (not shown). Heated fluid may be essential for promoting diver safety in low-temperature waters, which may be as cold as 2 degrees Celsius. However, chilled fluid may also be provided for divers working in hot-water environments, such as around thermal vents. In both scenarios, the fluid supply 150, the suit 110, and other equipment function to keep a diver's body temperature within safe and comfortable limits. The heat-transfer fluid is preferably water, which may be obtained directly from the local environment, but alternatives may include glycol, glycol/water solutions, and dielectric fluids such as fluorocarbons and polyalphaolefin (PAO).

The depiction of FIG. 1 is intended to be simplified. In a typical arrangement, multiple divers may wear respective suits 110, all of which connect to a common fluid supply 150. Various connection schemes may be used among the suits 110, such as a series arrangement or a reverse-return arrangement. Also, various distributer modules (not shown) may be provided for distributing supply and return lines to individual groups of divers and to individual divers. Such distributer modules are preferably insulated to minimize heat transfer to surrounding water in the environment.

Figure 2:
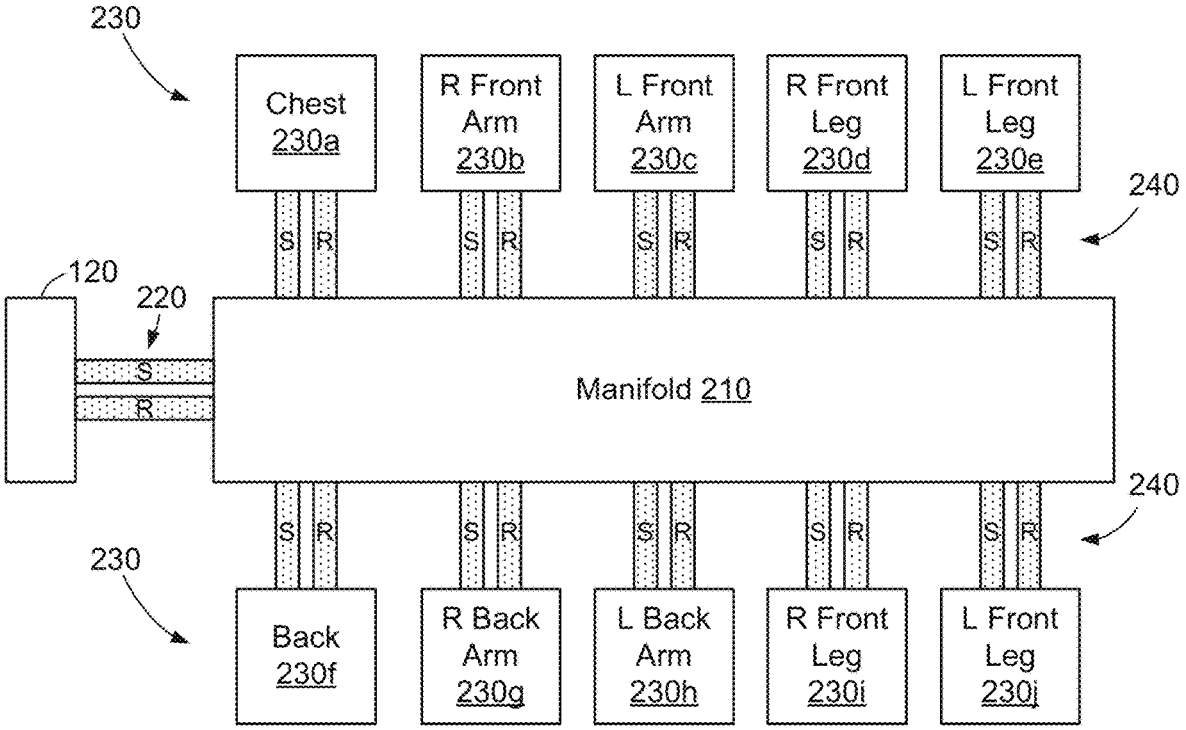
FIG. 2 is a block diagram of an example arrangement for distributing heating or cooling water within the diving suit of FIG. 1, according to some embodiments.

FIG. 2 shows and example arrangement for distributing heat-transfer fluid within the suit 110. As shown, a manifold 210 connects to source and return lines 220 of the diver-side connector 120 and distributes respective pairs of source and return lines to multiple temperature zones 230 inside the suit. Within the manifold 210, the source lines(S) are all connected together and the return lines (R) are all connected together, but none of the source lines are connected to any of the return lines. In an example, the temperature zones 230 include the following: a chest zone 230*a*; a front-right arm zone 230*b*; a front-left arm zone 230*c*; a front-right leg zone 230*d*; a front-left leg zone 230*e*; a back zone 230*f*; a back-right arm zone 230*g*; a back-left arm zone 230*h*; a front-right leg zone 230*i*; and a front-left leg zone 230*j*. These are merely examples, which are not intended to be limiting.

In an example, the manifold 210 is made of flexible plastic and has a low profile. The manifold 210 includes fittings connected to tubes 240, which are distributed to the different temperature zones 230. Preferably, the manifold is disposed between insulating layers of the suit 110 and may be located in an area of the suit, such as a lateral torso area, that is unlikely to interfere with other equipment worn by the diver. Although only a single manifold 210 is shown, multiple manifolds could instead be used, such as one for the front of the suit 110 and another for the back of the suit 110, or one for the top of the suit and another for the bottom. These are merely examples.

Figure 3:
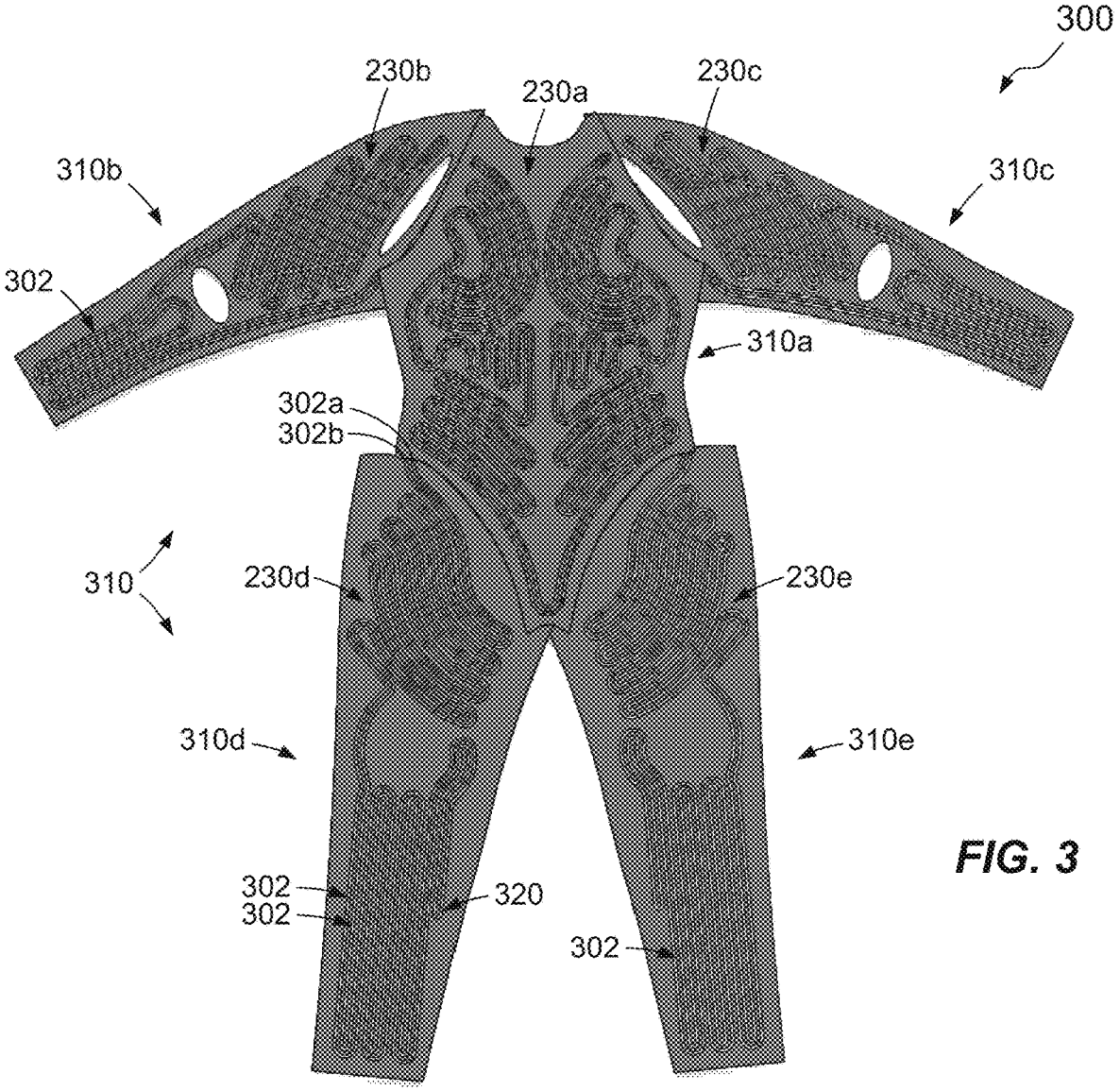
FIG. 3 is a diagram showing an example inner suit for use in the suit of FIG. 1, including channels in which tubes are disposed for carrying heating or cooling water, according to some embodiments.

FIG. 3 shows an example inner suit 300, which is normally disposed inside the suit 110. The inner suit 300 is composed of an insulating material, such as a fleece fabric. In an example, the inner suit 300 is formed in multiple sections 310, such as a torso section 310*a*, a right-arm section 310*b*, a left-arm section 310*c*, a right-leg section 310*d*, and a left-leg section 310*e*. The different sections 310 may remain separate or may be fastened together, e.g., using fasteners, sewing, or ultrasonic welding, for example.

In the example shown, each section 310 of the inner suit 300 includes one or more of the temperature zones 230. For example, the torso section 310*a* may include both the chest temperature zone 230*a* and the back temperatures zone 230*f*. In an example, each temperature zone 230 includes a single tube 240 disposed within a respective channel 302 of the fleece fabric. Preferably, the channels 302 are precision cut, e.g., using laser cutting.

An example channel 302 is shown within the front-right leg temperature zone 230*d* in section 310*d*. Here, the channel 302 has an inlet end 302*a* and an outlet end 302*b*. The inlet end 302*a* is continuous with the outlet end 302*b*. A single tube 240 extends within the channel 302 from the inlet end 302*a* to the outlet end 302*b*. The tube 240 also has an inlet end and an outlet end, which correspond respectively to the inlet end 302*a* and outlet end 302*b* of the channel 302. In an example, the channel 302 starts at the inlet end 302*a* and follows a back-and-forth path through section 310*d*, until it reaches a midpoint 320, at which point the channel 302 reverses and follows a reverse path alongside the path it took to reach the midpoint 320. The greatest temperature difference of fluid within the tube 240 is seen between the inlet end 302*a* and the outlet end 302*b*, and the smallest difference is seen at the midpoint 320, but the average temperature of the fluid tends to be constant for any pair of source and return channel portions, thus providing uniform heating across the entire zone 230 and thus across a surface of the diver's skin.

In an example, the channels 302 and the tubes 240 contained therein follow lines of non-extension, i.e., paths that are not subject to substantial extension or compression during normal movements of the diver. Following the lines of non-extension reduces pulling on the tubes 240 and prevents kinking, thus promoting continuous fluid flow. The tubes 240 within the channels 302 may be sewn or otherwise adhered to the fleece fabric, such as by ultrasonic welding.

In an example, the inner suit 300 is manufactured separately from the rest of the suit 110. The sections 310 are attached together, and both ends of the tube 240 of each temperature zone 230 are attached to the manifold 210. The completed inner suit 300 and manifold 210 are then inserted into the suit 110.

Figure 4:
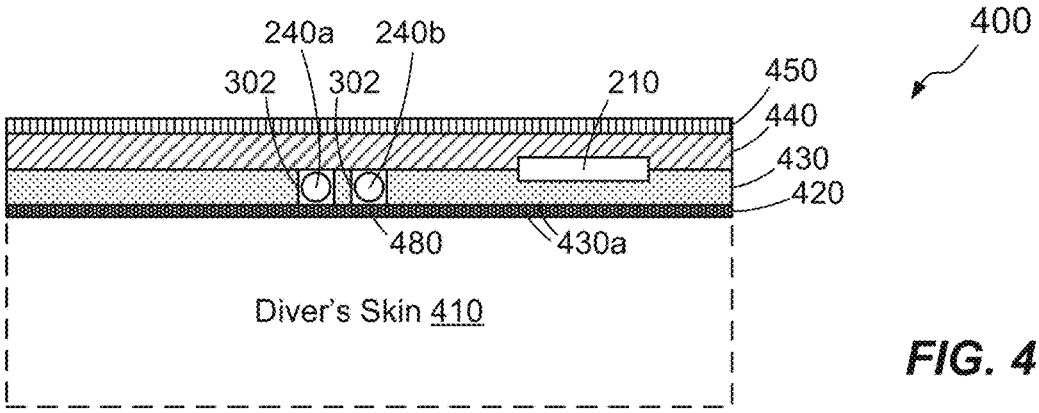
FIG. 4 is a diagram showing an example stack-up of layers in the diving suit of FIG. 1, according to some embodiments.

FIG. 4 shows an example stack-up 400 of layers within the suit 110. For example, the depiction of FIG. 4 may represent a cross-section of any portion of the suit 110. The illustrated stack-up 400 sits above a diver's skin 410 and includes a skin-contact layer 420, a first insulating layer 430, a second insulating layer 440, and a water-impermeable outer layer 450.

The skin-contact layer 420 is preferably a thin, 4-way stretch material, such as Under Armour®, which is breathable and provides low CLO (clothing insulation value). The skin-contact layer 420 improves diver comfort and does not interfere substantially with heat conduction between the tube 240 and the diver's skin 410.

The first insulating layer 430 includes the above-described insulating material of the inner suit 300, which may be Thinsulate fleece material or some other densely woven fleece. The first insulating layer 430 has a diver-facing surface 430*a*. As shown, the first insulating layer 430 includes a channel 302, such as any of the channels 302 described above in connection with FIG. 3. A tube 240 runs within the channel 302. Two portions 240*a* and 240*b* of the same tube 240 are shown, one heading from the inlet end 302*a* of the channel toward the midpoint 320, and the other heading back to the outlet end 302*b* of the same channel. Although the two portions 240*a* and 240*b* of the tube are shown within separate, side-by-side portions of the same channel 302, both tube portions 240*a* and 240*b* may instead be placed in a single portion of a channel 302. This alternative arrangement may be suitable if the tube 240 has a dual-lumen construction. The positioning of the tube 240 within the channel 302 of the first insulating layer 430 protects the diver's skin 410 from pressure points when the tube 240 is inflated with fluid, thus promoting diver comfort. In some examples, the tube 240 has a flat bottom 480 when inflated with fluid, such that the bottom of the tube 240 aligns substantially with the diver-facing surface 430*a* of the fleece material on either side of it, thus further protecting the diver from pressure points.

The second insulating layer 440 is disposed directly above the first insulating layer 430. As described further below, the second insulating layer 440 may include a set of wrapped insulating panels. The above-described manifold 210 (FIG. 2) is preferably disposed between the first and second insulating layers 430 and 440. This location protects the diver from pressure and/or abrasion from the manifold 210 and its tubing, and it also protects the manifold 210 from damage resulting from contact with objects in the environment.

The water-impermeable outer layer 450 provides a barrier between the outside environment and the inside of the suit 110. In an example, the outer layer 450 is simply a dry suit in which the other layers are inserted. The outer layer 450 may be composed of waterproof material, such as crushed neoprene.

Figure 5A:
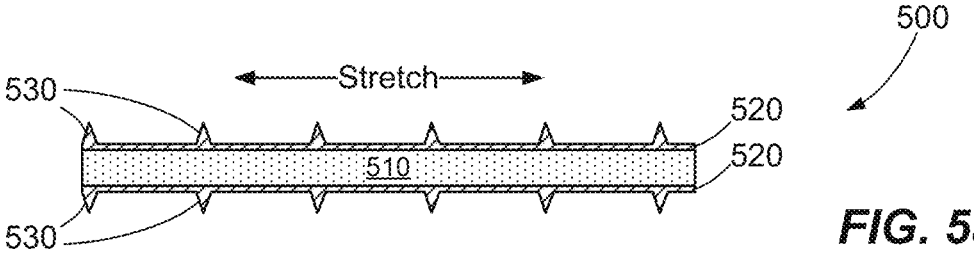
FIGS. 5*a*, 5*b*, and 5*c* are respective cross-sectional, offset edge-on, and top views of an example panel provided within a second insulating layer of the diving suit of FIG. 1, according to some embodiments.
Figure 5B:
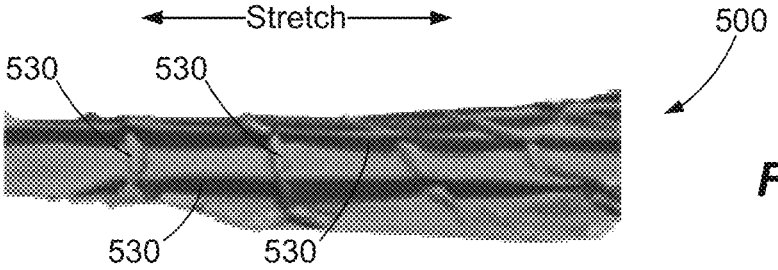
Figure 5C:
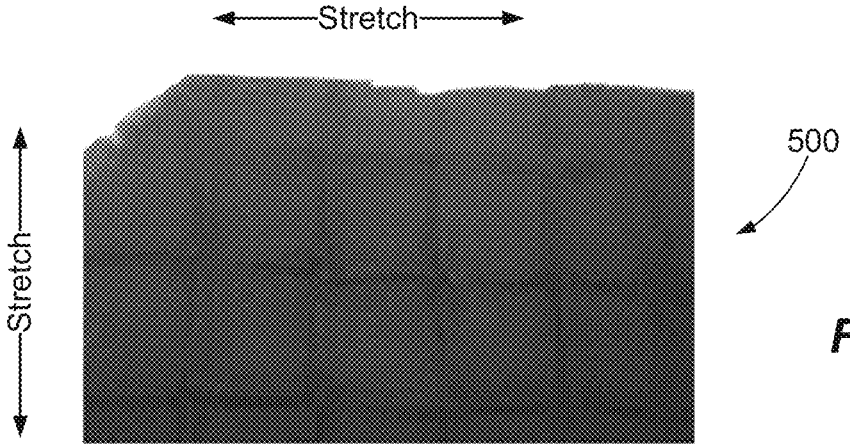

FIGS. 5*a* through 5*c* show an example fabric-wrapped panel 500 which may be included in the second insulating layer 440. For example, one or more panels 500 may be arranged end-to-end or in an overlapping pattern to constitute the second insulating layer 440. The panels 500 may be inserted into the suit 110 above the first insulating layer 430.

FIG. 5*a* shows an example wrapped panel 500 in cross-section. Here, the panel 500 includes a flexible silica gel panel 510, such as a flexible Aerogel panel, surrounded by fabric 520. Although Aerogel has high insulating properties, it tends to produce dust that can be caustic. The fabric 520 contains the dust and prevents it from migrating to the diver's skin 410, where it could otherwise cause irritation. A suitable example of the fabric 520 includes an expanded polytetrafluorethylene (ePTFE) fabric, such as e Vent fabric or Gore-Tex. As such fabrics are not inherently elastic, folds 530 may be formed in the fabric 520. As the underlying Aerogel panel 510 is stretched and released, the folds in the fabric 520 open and re-form, accordion-style, conferring elastic properties to the overall panel 500. As shown in FIGS. 5*b* and 5*c*, folds 530 may be formed in two directions, such as vertically and horizontally (FIG. 5*c*), enabling 4-way stretch.

Figure 6A:
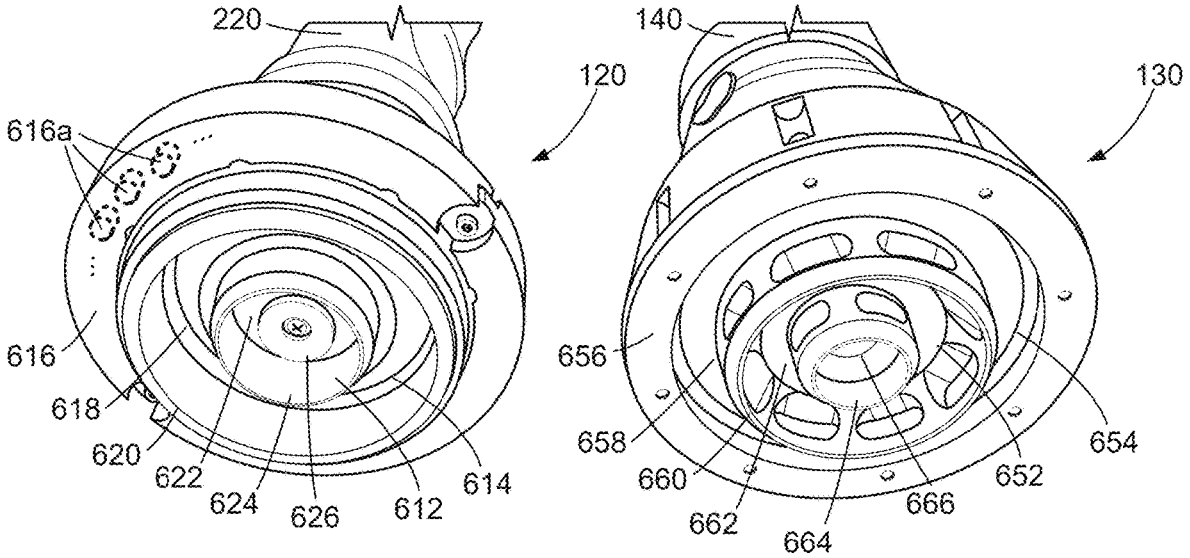
FIGS. 6*a* and 6*b* are respective views of a pair of connectors for connecting the diving suit of FIG. 1 to a fluid supply, with the connectors separated (FIG. 6*a*) and with the connectors mated (FIG. 6*b*), according to some embodiments.
Figure 6B:
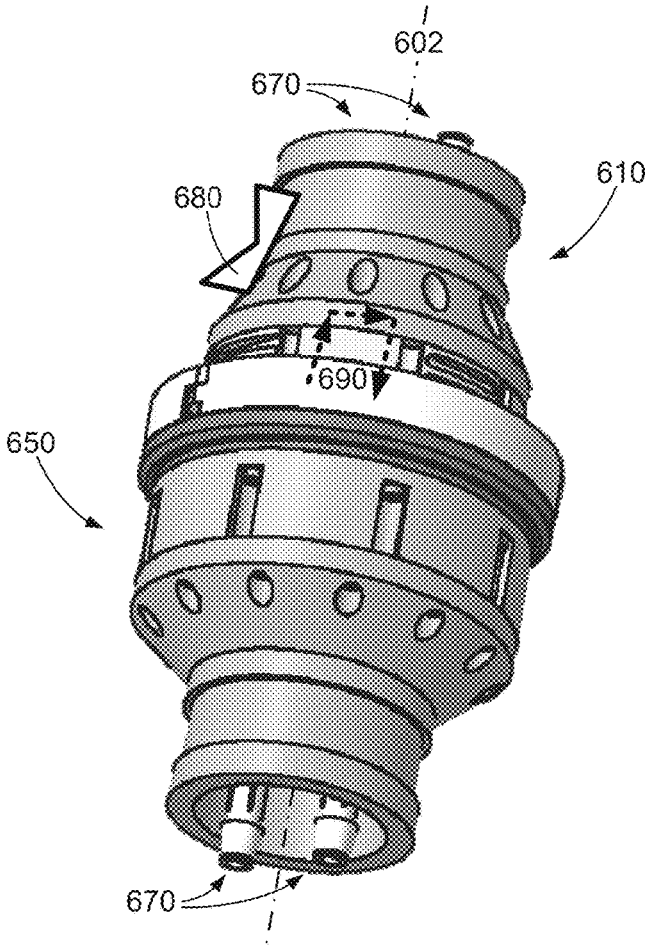

FIGS. 6*a* and 6*b* show examples of the diver-side connector 120 and supply-side connector 130 in additional detail. The connectors 120 and 130 are designed to provide quick-disconnect capability and to prevent heat loss and fluid leakage. The connectors 120 and 130 are also designed to be omnidirectional, meaning that they can be mated at any relative angle (twist) about a common axis 602 (FIG. 6*b*).

The quick-disconnect capability is achieved by a magnetic closure between the two connectors 120 and 130. For example, the diver-side connector 120 may have a non-magnetic outer support 616 in which magnets 616*a* are inserted (e.g., from the rear in the perspective of FIG. 6*a*). Although only three magnets 616*a* are shown, one should appreciate that magnets 616*a* may be placed uniformly around the outer support 616, for providing uniform magnetic force. In some examples, an additional central magnet 626 may be provided. The supply-side connector 130 has complementary features to support magnetic closure. These include an outer support 656 made of a ferromagnetic material, such as stainless steel. A similarly constituted magnetic target 666 may be provided centrally. As the two connectors 120 and 130 are aligned axially and brought into proximity of each other, the magnets 616*a* and 626 attract the magnetic support 656 and target 666, respectively, pulling the assembly closed (FIG. 6*b*). As there are no mechanically interlocking or latching parts, the two connectors 120 and 130 can be easily separated by pulling them axially apart. Thus, even when divers are wearing insulated gloves that impair dexterity, the divers may still easily connect and disconnect the connectors 120 and 130.

In an example, prevention of heat loss and fluid leakage is achieved using a system of rings and gaskets. For example, the diver-side connector 120 includes an outer ring 620 and an inner ring 624, as well as an outer gasket 618 and an inner gasket 622. An outer annular region 614 is formed between the outer ring 620 and the inner ring 624, and an inner annular region 612 is formed between the inner ring 624 and the central magnet 626.

The supply-side connector 130 has a similar and complementary design. For example, the supply-side connector 130 includes an outer ring 660 and an inner ring 664, as well as an outer gasket 658 and an inner gasket 662. An outer annular region 654 is formed between the outer support 656 and the outer ring 660, and an inner annular region 652 is formed between the outer ring 660 and the inner ring 664.

Within each connector 120 or 130, the respective outer annular region 614 or 654 is tapered down to a first fitting 670, e.g., a barb fitting, and the respective inner annular region 612 or 652 is tapered down to a second fitting 670. One fitting provides an inlet of the connector and the other fitting provides an outlet. Except for a small trickle path 690, which may be provided as an option in the diver-side connector 120, the paths between the outer and inner annular regions and the two fittings 670 are kept entirely separate.

When the two connectors 120 and 130 are separated (disconnected), the gaskets 618, 622, 658, and 662 are closed, blocking the flow of fluid into or out of the respective connectors. However, when the connectors are engaged, the outer ring 620 and the inner ring 624 of the diver-side connector 120 push open the outer gasket 658 and the inner gasket 662, respectively, of the supply-side connector 130. Likewise, the outer ring 660 and the inner ring 664 of the supply-side connector 130 push open the outer gasket 618 and the inner gasket 622, respectively, of the diver-side connector 120. With connectors mated and the gaskets open, heat-transfer fluid may flow between the outer annular regions 614 and 654 of the two connectors 120 and 130, and between the inner annular regions 612 and 652 of the two connectors 120 and 130. In the manner described, fluid can flow between the two connectors when the connectors are engaged, but fluid flow is blocked individually by both connectors 120 and 130 when the connectors are disengaged.

In some examples, the diver-side connector 120 includes a shutoff switch 680, which when thrown blocks the flow of fluid into or out of the connector 120, even when the two connectors 120 and 130 are engaged. For example, the diver can throw the switch 680 if the diver is getting too hot (or too cold, if chilled fluid is used). In some examples, the trickle path 690 enables a low rate of fluid flow between the inner and outer annular regions 612 and 614 of the diver-side connector 120 when the switch 680 is thrown. This feature keeps fluid flowing from the fluid supply 150 and prevents fluid within the lines 140 from reaching thermal equilibrium with the environment. In some examples, the trickle path 690 is present only when the switch 680 is thrown; however, it may alternatively be present regardless of whether the switch 680 is thrown.

Figure 7:
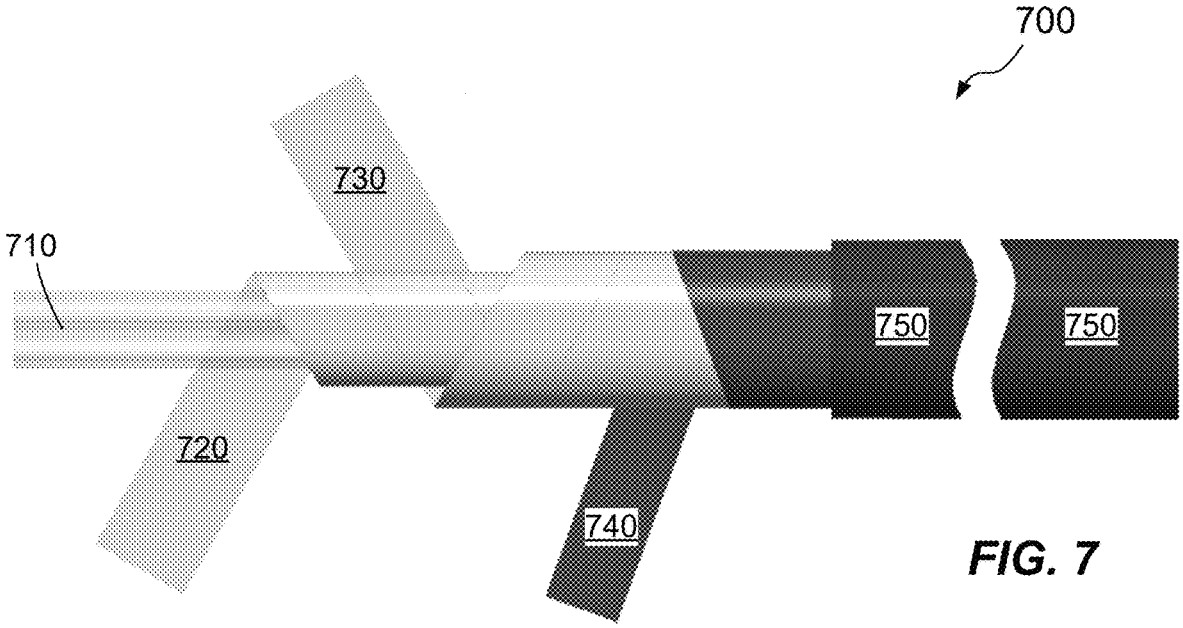
FIG. 7 is a diagram showing an example arrangement of layers of an insulated water line, which may be provided between the diving suit and the fluid supply of FIG. 1, according to some embodiments.

FIG. 7 shows an example construction 700 of fluid lines 140, which run between the fluid supply 150 and the suit 110. The construction 700 is designed to provide thermal insulation between the fluid being delivered and the environment, while still providing flexibility.

The construction 700 includes a pair of central tubes 710, which may be provided as a single, dual-lumen tube (e.g., two tubes joined together along their length). The central tubes 710 are surrounded by two oppositely wound layers 720 and 730 of flexible silica gel, such as Aerogel. For example, the first layer 720 may be wound counterclockwise, and the second layer 730 may be wound clockwise. Preferably, the winding of the layers 720 and 730 are performed in a high-speed manufacturing process, e.g., one in which the tubes 710 are pulled through machinery as the layers of wrap 720 and 730 are applied. In some examples, an additional wrap 740, such as electrical tape or another type of adhesive tape, is applied over the second layer 730, which holds the other layers together until an exterior jacket 750 can be applied. For example, the jacket 750 may be formed by dipping the taped assembly into a liquid polymer and extruding the dipped assembly through a fixed-diameter ring.

Figure 8:
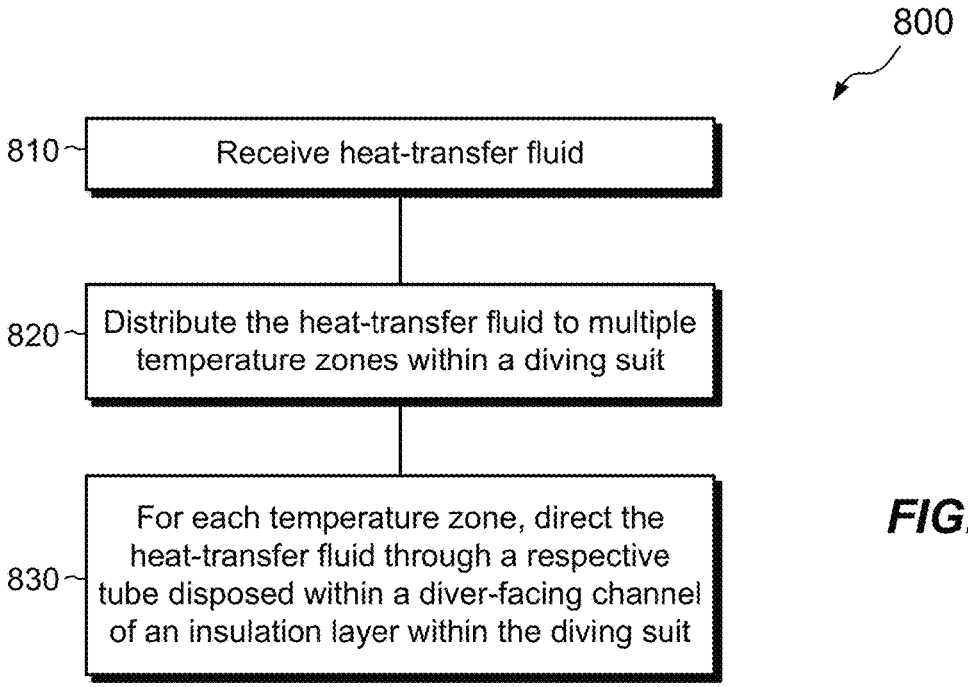
FIG. 8 is a flowchart showing an example method of operating the diving suit of FIG. 1, according to some embodiments.

FIG. 8 shows an example method 800 for operating a thermal management system as described herein and provides a summary of some of the features described above. At 810, a suit 110 receives temperature-controlled fluid, such as water or some other heat-transfer fluid from the fluid supply 150. At 820, the suit 110 distributes the heat-transfer fluid to multiple temperature zones 230 within the suit 110, such as the temperature zones shown in FIG. 2. At 830, for each temperature zone 230, the heat-transfer fluid is directed through a respective tube 240 disposed within a diver-facing channel 302 of an insulating layer 430 within the suit 110.

An improved technique has been described for thermal management of divers. The technique includes a dry suit 110 having an internal, insulating layer 430 with cutout channels 302 in which tubes 240 are disposed for carrying heat-transfer fluid to the proximity of a diver's skin 410. The tubes 240 are recessed within the channels 302, such that the tubes 240 when inflated with heat-transfer fluid achieve close contact with the diver's skin 410 without concentrating pressure on the diver's skin.

Having described certain embodiments, numerous alternative embodiments or variations can be made. For example, although embodiments have been described which include a second insulating layer 440, the second insulating layer 440 may be optional in other embodiments, and thus may be omitted. Similarly, the skin-contact layer 420 may be omitted in certain embodiments.

Further, although embodiments have been described in which the suit 110 includes multiple temperature zones, this is merely an example, as the suit 110 may alternatively include only a single temperature zone, or a fewer number of such zones than what is shown.

Further, although features have been shown and described with reference to particular embodiments hereof, such features may be included and hereby are included in any of the disclosed embodiments and their variants. Thus, it is understood that features disclosed in connection with any embodiment are included in any other embodiment.

As used throughout this document, the words "comprising," "including," "containing," and "having" are intended to set forth certain items, steps, elements, or aspects of something in an open-ended fashion. Also, as used herein and unless a specific statement is made to the contrary, the word "set" means one or more of something. This is the case regardless of whether the phrase "set of" is followed by a singular or plural object and regardless of whether it is conjugated with a singular or plural verb. Also, a "set of" elements can describe fewer than all elements present. Thus, there may be additional elements of the same kind that are not part of the set. Further, ordinal expressions, such as "first," "second," "third," and so on, may be used as adjectives herein for identification purposes. Unless specifically indicated, these ordinal expressions are not intended to imply any ordering or sequence. Thus, for example, a "second" event may take place before or after a "first event," or even if no first event ever occurs. In addition, an identification herein of a particular element, feature, or act as being a "first" such element, feature, or act should not be construed as requiring that there must also be a "second" or other such element, feature or act. Rather, the "first" item may be the only one. Also, and unless specifically stated to the contrary, "based on" is intended to be nonexclusive. Thus, "based on" should be interpreted as meaning "based at least in part on" unless specifically indicated otherwise. Further, although the term "user" as used herein may refer to a human being, the term is also intended to cover non-human entities, such as robots, bots, and other computer-implemented programs and technologies. Although certain embodiments are disclosed herein, it is understood that these are provided by way of example only and should not be construed as limiting.

Those skilled in the art will therefore understand that various changes in form and detail may be made to the embodiments disclosed herein without departing from the scope of the following claims.

Table of Reference Numerals

| Reference: | Description: |
|---|---|
| 100 | Example system for thermal management of divers |
| 110 | Suit (worn by diver) |
| 120 | Diver-side connector |
| 130 | Supply-side (mating) connector |
| 140 | Water lines |
| 140r | Return line (from suit) |
| 140s | Supply line (to suit) |
| 150 | Fluid supply, e.g., source of temperature-controlled water |
| 210 | Manifold, e.g., within suit, e.g., for distributing water to different temperature zones |
| 220 | Lines (source and return) connecting source and return of diver-side connector to manifold |
| 230 | Temperature zones |
| 230a-230j | Individual temperature zones, such as (a) chest, (b) front of right arm, (c) front of left arm, (d) front of right leg, (e) front of left leg, (f) back, (g) back of right arm, (h) back of left arm, (i) front of right leg, and (j) front of left leg |
| 240 | Tubes connected to temperature zones |
| 240a, 240b | Two portions of the same tube |
| 300 | Inner suit |
| 302 | Channel |
| 302a, 302b | Channel portions |
| 302a, 302b | Inlet and outlet ends of channel |
| 310 | Sections of the inner suit |
| 310a | Torso section of inner insulating layer |
| 310b | Right arm section of inner insulating layer |
| 310c | Left arm section of inner insulating layer |
| 310d | Right leg section of inner insulating layer |
| 310e | Left leg section of inner insulating layer |
| 320 | Midpoint of channel/tube |
| 400 | Example layers of suit |
| 410 | Diver's skin |
| 420 | Skin-contact layer; e.g., low CLO fabric with 4-way stretch, such as Under Armour ® |
| 430 | First insulating layer; e.g., fleece, such as Thinsulate ® Insulation |
| 430a | Diver-facing surface of first insulation layer |
| 440 | Second insulating layer, such as flexible silica gel panel(s) (e.g., flexible Aerogel ®) surrounded by breathable, waterproof fabric, such as an expanded polytetrafluorethylene (ePTFE) fabric, e.g. e Vent or Gore-Tex) |
| 450 | Water-impermeable outer layer, e.g. a dry suit made of crushed neoprene |
| 480 | Flat undersurface of tube, e.g., avoids pressure points on diver's skin |
| 500 | Fabric-wrapped panel; forms at least part of second insulating layer |
| 510 | Flexible silica gel panel (e.g., flexible Aerogel ®) |
| 520 | Breathable, waterproof fabric that surrounds panel, such as an expanded polytetrafluorethylene (ePTFE) fabric, e.g. eVent or Gore-Tex) |
| 530 | Folds formed within fabric 520; enable 4-way stretch |
| 602 | Common axis of connectors 610 and 650 |
| 612 | Inner annular region of diver-side connector |
| 614 | Outer annular region of diver-side connector |
| 616 | Outer support (contains magnets) |
| 616a | Magnets (within outer support) |
| 618 | Outer gasket (seals outer annular region 614 when connectors disengaged) |
| 620 | Outer ring; e.g., pushes open outer gasket of supply-side connector 650 when connectors engaged |
| 622 | Inner gasket (seals inner annular region 612 when connectors disengaged) |
| 624 | Inner ring; e.g., pushes open inner gasket of supply-side connector 650 when connectors engaged |
| 626 | Central magnet |
| 652 | Inner annular region of supply-side connector |
| 654 | Outer annular region of supply-side connector |
| 656 | Outer support (e.g., steel) |
| 658 | Outer gasket (seals outer annular region 654 when connectors disengaged) |
| 660 | Outer ring; e.g., pushes open outer gasket of diver-side connector 610 when connectors engaged |
| 662 | Inner gasket (seals inner annular region 652 when connectors disengaged) |

-continued

Table of Reference Numerals

| Reference: | Description: |
|---|---|
| 664 | Inner ring; e.g., pushes open inner gasket of diver-side connector 650 when connectors engaged |
| 666 | Steel target |
| 670 | Barb fittings |
| 680 | Rocker switch, e.g., diver-side shutoff |
| 690 | Trickle path, e.g., active when rocker switch closed |
| 710 | Dual-lumen extruded tubing |
| 720 | Flexible silica gel (e.g., Aerogel) first wrap |
| 730 | Flexible silica gel (e.g., Aerogel) second wrap (opposite direction) |
| 740 | Tape, e.g., electrical tape |
| 750 | Exterior jacket, e.g., extrusion |
| 800 | Method of operating suit |
| 810, 820, 830 | Acts of method 800 |

What is claimed is:

1. An apparatus for delivering heating or cooling to a diver, the apparatus comprising a suit, the suit including:

a water-impermeable outer layer;

an insulating layer having a channel extending along a diver-facing surface thereof; and a tube disposed within the channel of the insulating layer, the tube constructed and arranged for carrying heat-transfer fluid to a proximity of the diver's skin and recessed within the channel for protecting the diver's skin from concentrated pressure when filled with the heat-transfer fluid.

2. The apparatus of claim 1, wherein the suit further includes a skin-contact layer internal to the insulating layer, the skin contact layer being adjacent to the tube within the channel.

3. The apparatus of claim 2, wherein the skin-contact layer includes a four-way stretch fabric.

4. The apparatus of claim 1, wherein the insulating layer is a first insulating layer, and wherein the suit further includes a second insulating layer between first insulating layer and the water impermeable layer, the second insulating layer including a flexible silica gel panel surrounded by a breathable, waterproof fabric.

5. The apparatus of claim 4, wherein the breathable, waterproof fabric has a set of folds formed therein, the folds constructed and arranged to unfold as the flexible silica gel panel is stretched.

6. The apparatus of claim 5, wherein the folds are formed in two different directions to allow four-way stretching of the flexible silica gel panel.

7. The apparatus of claim 1, wherein the channel is constructed and arranged to extend along a back-and-forth path within the insulating layer to provide heating or cooling over an extended surface of the diver's skin.

8. The apparatus of claim 7, wherein the channel is constructed and arranged to extend along one or more lines of non-extension, such that the tube is not subject to substantial stretching or kinking during movements of the diver.

9. The apparatus of claim 8, wherein the tube folds back on itself at substantially a midpoint thereof.

10. The apparatus of claim 7, wherein the tube when inflated with heat-transfer fluid has a substantially flat outer surface that is constructed and arranged to face the diver's skin.

11. The apparatus of claim 1, wherein the insulating layer is contained within a first temperature zone of the suit, and wherein the suit further includes a set of additional temperature zones each including an insulating layer having a respective channel formed therein and a respective tube disposed within the channel.

12. The apparatus of claim 11, wherein the tube of each temperature zone has an inlet end and an outlet end, and wherein the apparatus further comprises a connector for carrying heat-transfer fluid into and out of the suit, the connector having an inlet coupled to the inlet end of the tube of each temperature zone and an outlet coupled to the outlet end of the tube of each temperature zone.

13. The apparatus of claim 12, wherein the connector includes a shutoff switch for selectively stopping heat-transfer fluid flow into or out of the suit and a bypass trickle path between the inlet and the outlet.

14. The apparatus of claim 12, further comprising a mating connector coupled to a heat-transfer fluid supply, wherein the connector and the mating connector form a quick-disconnect pair in which the mating connector is constructed and arranged to separate from the connector by pulling the mating connector axially away from connector.

15. The apparatus of claim 14, wherein the connector and the mating connector are held together by magnetic attraction and without any interlocking mechanical parts.

16. The apparatus of claim 14, wherein the connector and the mating connector are constructed and arranged to connect omnidirectionally along a common axis.

17. The apparatus of claim 14, further comprising a tubing line connected to the mating connector, the tubing line including:

a pair of tubes;

a first layer of flexible silica gel wrapped around the pair of tubes in a first direction;

a second layer of flexible silica gel wrapped around the first layer of flexible silica gel in a second direction; and an outer extrusion layer applied over the second layer of flexible silica gel.

18. The apparatus of claim 17, further comprising the mating connector, wherein the mating connector includes:

an annular inner region having an inner gasket that prevents fluid flow through the inner annular region of the mating connector when the connector and the mating connector are disconnected, wherein the inner gasket of the mating connector is constructed and arranged to open responsive to contact with the inner ring of the connector when the connector and the mating connector are connected;

an outer annular region having an outer gasket that prevents fluid flow through the outer annular region of the mating connector when the connector and the mating connector are disconnected, wherein the outer gasket of the mating connector is constructed and arranged to open responsive to contact with the outer ring of the connector when the connector and the mating connector are connected;

an inner ring constructed and arranged to extend partially into the connector to open the inner gasket of the connector when the connector and the mating connector are connected; and an outer ring constructed and arranged to extend partially into the connector to open the outer gasket of the connector when the connector and the mating connector are connected.

19. The apparatus of claim 12, wherein the connector is constructed and arranged to mate with a mating connector, and wherein the connector includes:

an annular inner region providing one of the inlet or the outlet of the connector, the annular inner region having an inner gasket that prevents fluid flow through the inner annular region when the connector and the mating connector are disconnected;

an outer annular region providing the other of the inlet or the outlet of the connector, the outer annular region having an outer gasket that prevents fluid flow through the outer annular region when the connector and the mating connector are disconnected;

an inner ring constructed and arranged to extend partially into the mating connector when the connector and the mating connector are connected; and an outer ring constructed and arranged to extend partially into the mating connector when the connector and the mating connector are connected.

20. The suit of claim 1, wherein the channel is a cutout feature of the insulating layer.

21. The suit of claim 1, wherein the tube includes a source portion and a return portion that run alongside each other within the insulating layer.

22. A suit for delivering heating or cooling to a diver, comprising:

a water-impermeable outer layer;

an insulating layer having a channel extending along a diver-facing surface thereof; and a tube disposed within the channel of the insulating layer, the tube constructed and arranged for carrying heat-transfer fluid to a proximity of the diver's skin and recessed within the channel for protecting the diver's skin from concentrated pressure when filled with the heat-transfer fluid.

23. The suit of claim 22, wherein the insulating layer is contained within a first temperature zone of the suit, and wherein the suit further includes a set of additional temperature zones each including an insulating layer having a respective channel formed therein and a respective tube disposed within the channel.

* * * * *